United States Patent [19]

Mattson

[11] Patent Number: 4,827,759

[45] Date of Patent: May 9, 1989

[54] DENT PULLING APPARATUS

[76] Inventor: Charles T. Mattson, 5184 Sonoma Hwy., Santa Rosa, Calif. 95405

[21] Appl. No.: 185,427

[22] Filed: Apr. 25, 1988

[51] Int. Cl.[4] ..... B21D 01/12

[52] U.S. Cl. ..... 72/447; 72/705

[58] Field of Search ..... 72/447, 458, 705

[56] References Cited

U.S. PATENT DOCUMENTS

| | | | |
|---|---|---|---|
| 1,684,797 | 9/1928 | Howson | 254/251 |
| 2,873,090 | 2/1959 | Hale et al. | 254/250 |
| 3,452,575 | 7/1969 | Williams et al. | 72/447 |
| 3,729,974 | 5/1973 | Tidewell | 72/705 |
| 4,466,268 | 8/1984 | Matson, Sr. | 72/705 |

FOREIGN PATENT DOCUMENTS

| | | | |
|---|---|---|---|
| 2227849 | 12/1973 | Fed. Rep. of Germany | 72/705 |
| 2616743 | 3/1977 | Fed. Rep. of Germany | 72/705 |

*Primary Examiner*—Lowell A. Larson
*Attorney, Agent, or Firm*—Melvin R. Stidham

[57] ABSTRACT

The dent pulling apparatus includes a rectangular tubular pulling tool having a wheel eccentrically mounted therein. A pin, which has been welded to a dented panel is inserted into one end of the pulling tool and positioned between the wheel and the wall of the tubular member so that a pull on the pin tends to rotate the eccentric wheel in a direction to tighten the grip. A fulcrum plate is slidably carried on a tubular beam that is positioned parallel to the panel to be pulled and is both supported on the floor and anchored to the vehicle. A lever, on the side of which is carried one or more of the pulling tools, is pivoted on the fulcrum plate so that a pull on the lever pulls the dent out to its normal configuration.

5 Claims, 3 Drawing Sheets

DENT PULLING APPARATUS

BACKGROUND OF THE INVENTION

In removing dents from sheet metal panels, forming the outer shell of automotive vehicles, it is common practice to pound the dent out by hammering against the opposite or inner surface of the panel where the opposite surface is accessible, as in the case of the inner surface of a fender. In those areas wherein the inner surface is not accessible without removing interior lining, as in body panels, it is common practice to secure a bolt or screw to the panel and pull the dent out by impacting a slidable weight or hammer against an anvil. These methods of straightening vehicle body panels have proved generally satisfactory, but they tend to leave an outwardly directed "lump" where the screw or other pulling member is attached to the panel.

OBJECTS OF THE INVENTION

It is an object of this invention to provide an apparatus that can be operated to pull a dent smoothly from a vehicle body panel.

It is a further object of this invention to provide apparatus for removing a dent from a metal panel without leaving a "lump" around the pulled area.

It is a further object of this invention to provide a device that can be operated manually to remove a dent from a vehicle body panel quickly and easily.

It is a further object of this invention to provide an apparatus for removing a dent from a vehicle body panel wherein the operator has closer control over the dent-removing force that is applied to the panel.

Other objects and advantages of this invention will become apparent from the description to follow, particularly when read in conjunction with the accompanying drawings.

SUMMARY OF THE INVENTION

The dent pulling apparatus of this invention includes a lever that can be pulled manually to pull a dent from a vehicle body panel. There is a handgrip at one end of the lever, and the lever is pivotally mounted by seating the other end in an oversize hole in a fulcrum plate. The fulcrum plate is positioned selectively on a rail disposed parallel to the panel being worked on and the rail is anchored to the vehicle as well as being supported firmly on the floor. One or more pins are welded at one end to the panel in the area of the dent, and each pin is gripped by a unique gripping tool. Several such gripping tools may be attached to a single gang puller, which is selectively positioned along the lever. Hence when the operator pulls on the lever, several pins are pulled substantially uniformly to pull the dent smoothly out to the profile of the original panel.

DESCRIPTION OF PREFERRED EMBODIMENTS

Figure 1:
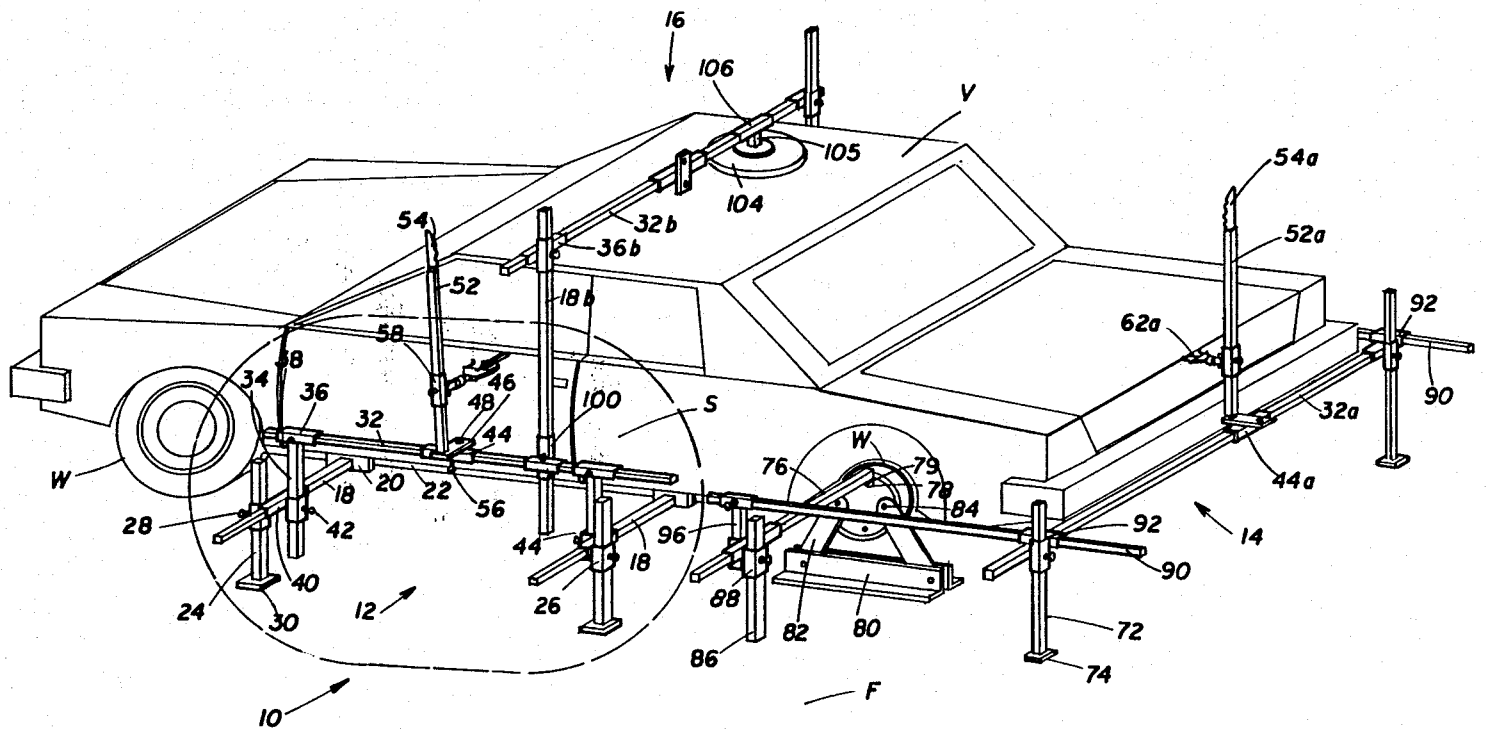
FIG. 1 is a view in perspective of the dent pulling apparatus of this invention arranged in several different configurations.

Referring now specifically to FIG. 1, the dent pulling apparatus 10 of this invention may be assembled to form a side panel pulling system 12, a front or rear panel pulling system 14 and a roof or top panel pulling system 16.

THE SIDE PANEL PULLING SYSTEM

Figure 2:
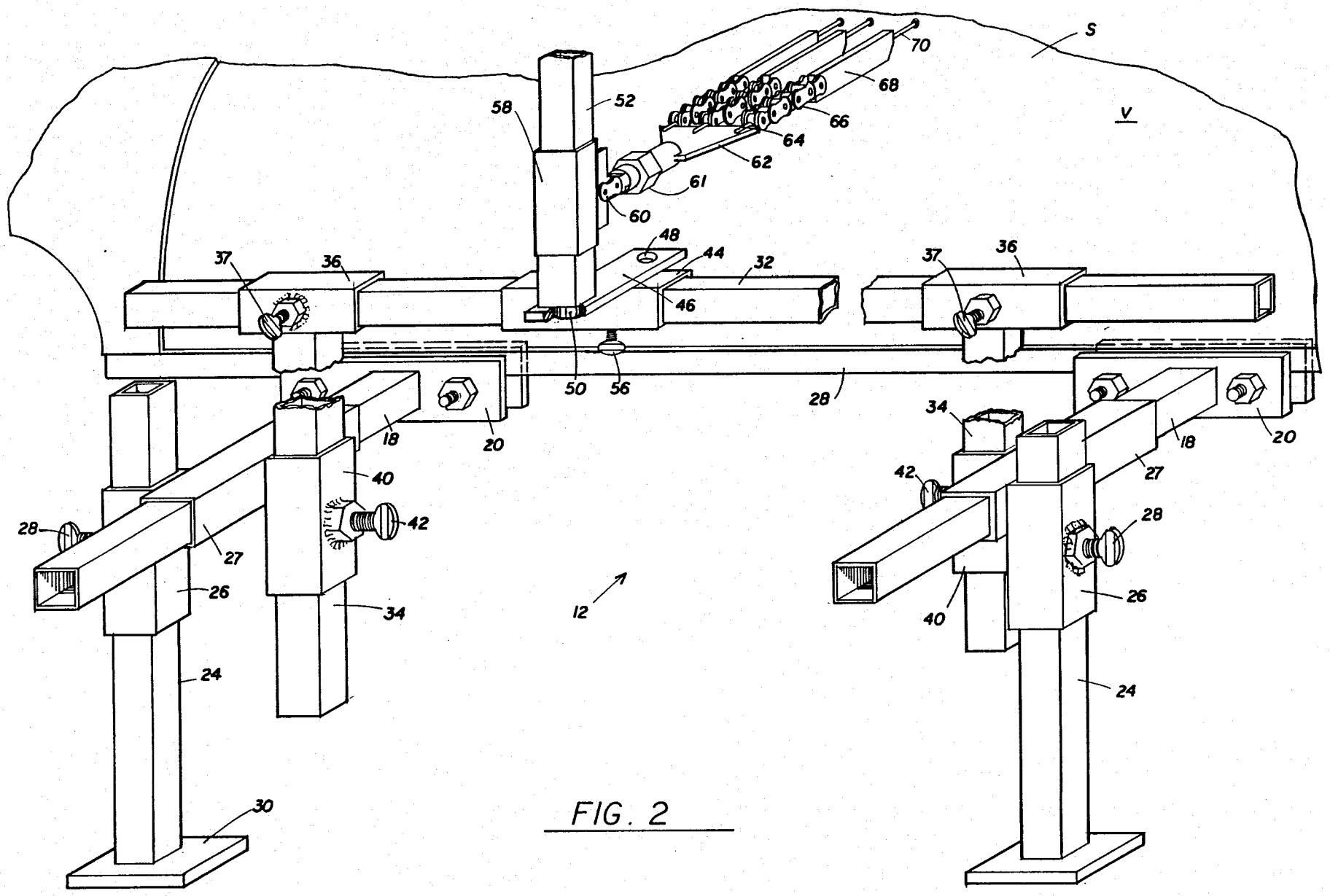
FIG. 2 is a somewhat enlarged view in perspective showing the dent pulling apparatus as arranged for pulling a dent from a side body panel.

Now considering also FIG. 2, the side panel pulling assembly 12 includes spaced side rails 18, each of which is firmly anchored to the automotive vehicle V, as by means of a clamp 20 carried on the end thereof. Preferably the clamp 20 firmly grips the lower edge or rocker sill of the vehicle V, where the side panel S, the floor panel and the frame are united to form a beam-like structure that conventionally extends across the bottom of the side panel S between the wheels W of the vehicle V. The outer end of each side rail 18 is supported on the ground or floor F of the work area by means of legs 24 that are slidably carried in slide sleeves 26, which are welded or otherwise secured to horizontal sleeves 27 received on the side rails 18. A thumb-operated screw or the like 28 is tightened to secure each leg 24 in vertically adjusted position. For improved load distribution, the legs are preferably provided with feet 30.

A fulcrum slide rail 32 is disposed generally parallel to that portion of the vehicle side panel S from which a dent is to be pulled, the fulcrum slide rail being supported from the side rails 18 on support posts 34. The fulcrum slide rail 32 is slidably received in sleeves 36 secured to the top of the support posts 34 and each end of the slide rail 32 is secured in place by a thumb operated screw 37.

The elevation of the fulcrum slide rail 32 is adjusted by sliding the support posts in vertical slide sleeves 40 and fixing them in position by means of thumb operated screws 42, which are threadedly received in the vertical sleeves 40.

A fulcrum positioning slide 44 has a transverse fulcrum plate 46 with oversized holes 48 to loosely receive a pin 50 (FIG. 2), which extends from the end of a lever 52 having a hand grip 54 at the upper end thereof. The fulcrum positioning sleeve 44 is secured in position by means of a screw 56. A sleeve 58 is slidably received on the lever 52 so as to be selectively positioned along the lever for desired mechanical advantage in pulling in a direction transverse thereto.

Pivotally secured at 60 to the sleeve 58 is a quick-disconnect coupling 67 carrying a gang-pull bracket 62 with hooks 64, which are adapted to engage at selected links along chains 66, which are carried on pin pullers or grippers 68. As will be described in greater detail, the pullers 68 pull on pins 70 which have been welded at their ends to the vehicle side panel S, in the area from which a dent is to be removed. The selection of the particular link on each chains 66 to be engaged is dependent upon the depth of the dent at the location of the pin 70, so that a relatively uniform pull is applied all across the span of the panel dent.

When the pins 70 have been welded to the side panel S and gripped by the pullers 68, all of the pullers 68 may be pulled uniformly across the dent, with all of the chains 66 relatively taut at the outset. Then, with a pull on the lever 52 applied by the operator at the hand grip 54 the panel S is re-aligned to its normal configuration. Ordinarily, a few taps with a hammer around the dented area after the dent has been removed will relieve stresses and complete the restoration process.

THE REAR PANEL PULLING SYSTEM

Here, the fulcrum slide 44*a* is secured on a fulcrum slide rail 32*a*, which in turn, is supported at a selected height on the floor F by means of adjustable legs 72 with feet 74.

Figure 6:
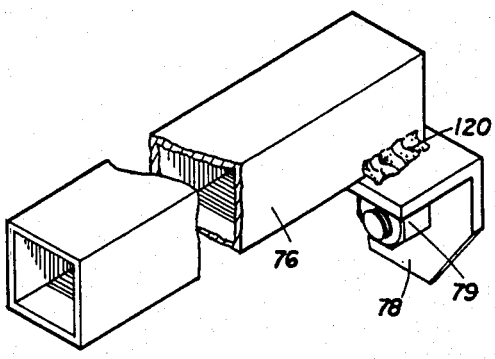
FIG. 6 is an enlarged view in perspective of means for anchoring the pulling assembly to the wheel of a vehicle.

In this case, the system is anchored to each side of the vehicle by means of an outwardly extending perpendicular rail 76 having a bracket plate 78 (FIG. 6) that is secured to the rear wheel W by removing and then re-attaching a lug nut 79. First, the wheel W is anchored in place by jacking the car up, removing the wheel and then mounting a support base 80 by securing legs 82 thereon to the wheel drain W with lug nuts 84. This fixes each wheel drum W and, hence, the perpendicular rail 76 firmly in place. The side rail 76 is also preferably supported on the floor F by means of an adjustable leg 86 carried in a vertical slide sleeve 88.

A similar anchor assembly is made on the other side of the vehicle by attachment to the wheel drum and then the rear panel pulling assembly 14 is anchored to the vehicle by means of side rails 90 that are received in slide sleeves 92 on the rear legs 72 and side support posts 96, respectively.

Again, a vertical lever 52*a* having a handgrip 54*a* is operated from the rear fulcrum rail 32*a* as in the side panel pulling assembly. A gang puller 62*a* may be adjustably positioned on the vertical lever 52*a* for pulling a sizable dent.

OVERHEAD PULLING ASSEMBLY

In this case, the fulcrum slide rail 32*b* is adjustably positioned by sliding T-sleeves 36*b* carried thereon over vertical side rails 18*b*. The vertical side rails 18*b* may be slidably supported in T-slides 100 which, in turn, are slidably received on fulcrum slide rails 32 or 32*a*, previously positioned along the sides of the vehicle. If desired, the horizontal slide rail 32*b* may be supported by a pad 104 that is pivotally carried on an arm 105 depending from a sleeve 106, the sleeve 106 being slidably received on the fulcrum slide rail 32.

Figure 5:
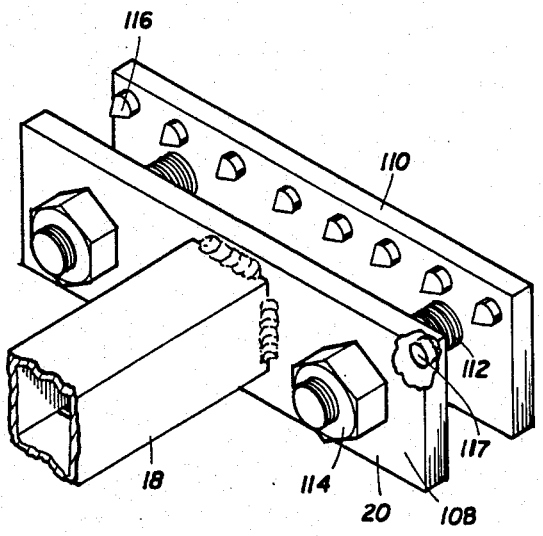
FIG. 5 is an enlarged view in perspective of means for anchoring the pulling apparatus to vehicle body panel.

Referring now to FIGS. 2 and 5, the side panel pulling assembly side rail 18 is anchored to the sill plate 28 of the vehicle V by means of a clamp device having front and rear plates 108 and 110, which are secured together by bolts 112, which are threadedly received in nuts 114. A series of pointed projections 116 are received in complementary holes 117 in the front clamp plate 108 to bite into the metal of the sill plate and grip the anchor plate 20 firmly in place. In FIG. 1 is shown the means for securing the perpendicular rail 76 in place on the wheel. The mounting bracket 78 is welded at 120 to the side rail and receives the conventional lug bolt secured in place by a lug nut 79.

THE PULLING GRIPPER

Figure 3:
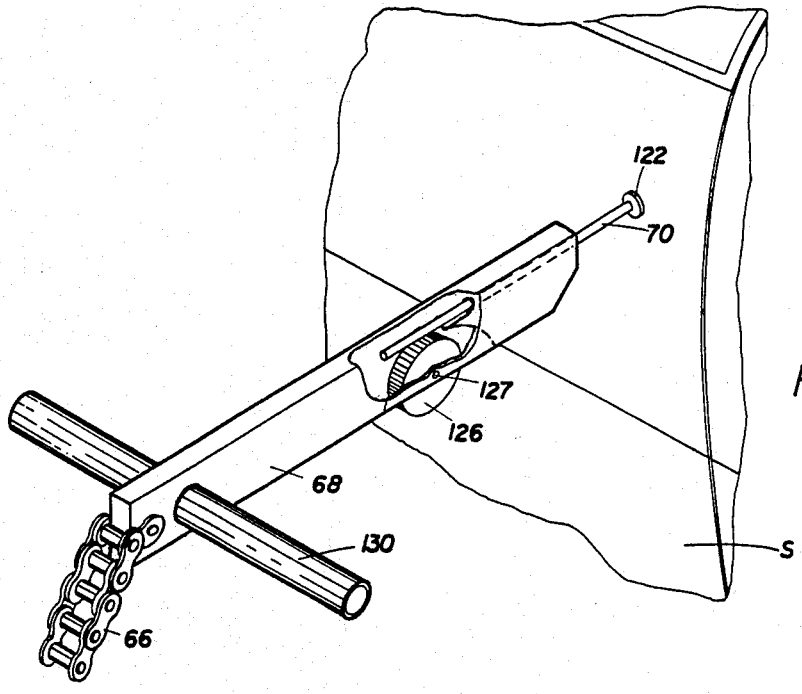
FIG. 3 is an enlarged view in perspective of a single pin-gripping tool.
Figure 4:
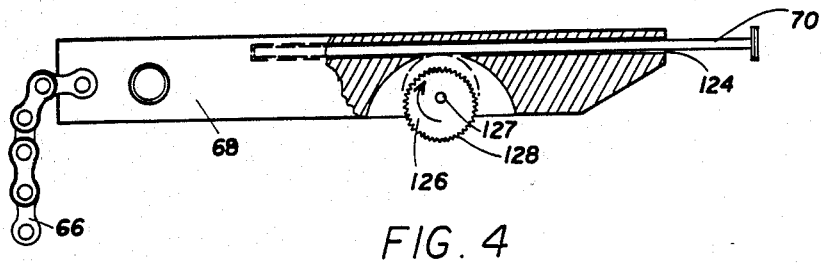
FIG. 4 is a side view partially broken away of the pin-gripping tool.

Referring now to FIGS. 3 and 4, the pulling gripper 68 for gripping the nail-like pins 70 are shown in greater detail. The pins 70 are first secured to the side panel S of the vehicle by welding a head 122 thereon to the side panel S itself. Each pin 70 is then inserted into an opening 124 at the end of a puller, and the pin is positioned over the top of an eccentric wheel 126 having a knurled peripheral surface 128 to grip the peg 70. The wheel is eccentrically mounted at 127, as shown particularly in FIG. 4 so that as it is turned in the clockwise direction indicated, the knurled surface 128 moves against the surface of the pin 70 and grips it firmly. Thereafter, as pull on the gripper is asserted and increased, the knurled wheel 126 will grip the pin 70 tighter and tighter. The grip is such that, frequently, when pulling is completed, the pin 70 has to be severed by snipping it, and then removed from the puller 68 by driving the pin 70 inward (to the left in FIG. 4) to turn the wheel 126 counter-clockwise and away from the pin 70.

The puller 68 has a chain 66 attached thereto for mounting on the gang puller 62 (FIG. 2). However, some small dents may be pulled by hand as indicated in FIG. 3 by application of a handgripping rod 130 into the puller 68. In any event, when the pulling is completed and the dent removed, the pins 70 are severed and the portion remaining is ground down to smooth the surface of the panel S for painting.

While this invention has been described in conjunction with preferred embodiments thereof, it is obvious that modifications and changes therein may be made by those skilled in the art to which it pertains without departing from the spirit and scope of this invention, as defined by the claims appended hereto.

What is claimed as invention is:

1. Apparatus for pulling dents from an automotive vehicle surface comprising:
- a fulcrum slide rail;
- a fulcrum member movable along said slide rail;
- means fixing said fulcrum member in a selected position along said slide rail;
- a lever;
- grip means on one end of said lever;
- interengaging means on the other end of said lever and on said fulcrum member enabling said lever to pivot about said fulcrum member;
- a pulling member slidable along said lever;
- means fixing said pulling member in a selected position along said lever;
- at least one appendage to be secured to said automobile surface;
- appendage gripping means on said pulling member;
- ground-engaging means for supporting an end of said slide rail at a selected elevation;
- said ground-engaging means comprising:
- a vertical sleeve on said beam;
- a leg slidably received in said vertical sleeve; and
- means securing said leg in a selected fixed position in said sleeve; and;
- vehicle engaging means for securing said end of the slide rail in fixed, spaced position relative to said vehicle surface;
- said vehicle engaging means comprising:
- a generally horizontal beam; and
- means on one end of said beam for releasably securing said beam to said vehicle.

2. The apparatus defined by claim 1 wherein the means for releasably securing said beam comprises:

a clamp plate secured to said beam so as to be perpendicular thereto;

a complementary clamp plate; and screw means for securing said clamp plates together.

3. The apparatus defined by claim 1 wherein said means for releasably securing said beam to said vehicle comprises:

a mounting bracket plate secured to said one end of the beam so as to be perpendicular thereto; and a hole in said mounting bracket for receiving a lug bolt on said vehicle.

4. The apparatus defined by claim 1 wherein:

said fulcrum member comprises a sleeve slidable along said slide rail;

a fulcrum plate with a hole therein secured transversely across said sleeve;

said lever includes:

a member extending from said other end of the lever to be loosely received in said hole.

5. The apparatus defined by claim 1 wherein:

said appendage comprises:

a pin welded at one end thereof to said automobile surface; and said appendage gripping means comprises:

a rectangular tubular member;

a wheel eccentrically mounted in said hollow member so that a pin may be received in said tubular member from one end thereof and positioned between the edge of said wheel and an inner wall of said tubular member and so that tension on said pin tends to rotate said wheel to tighten the grip on said pin.

* * * * *